US011761275B2

(12) United States Patent
Hitchcock et al.

(10) Patent No.: US 11,761,275 B2
(45) Date of Patent: Sep. 19, 2023

(54) DRILL STRING SOLIDS DEPLOYMENT

(71) Applicant: Saudi Arabian Oil Company, Dhahran (SA)

(72) Inventors: Graham Hitchcock, Aberdeenshire (GB); Michael Affleck, Aberdeenshire (GB); Pratyush Singh, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/528,918

(22) Filed: Nov. 17, 2021

(65) Prior Publication Data

US 2023/0175328 A1 Jun. 8, 2023

(51) Int. Cl.
*E21B 21/01* (2006.01)
*E21B 21/06* (2006.01)

(52) U.S. Cl.
CPC ..... *E21B 21/01* (2013.01); *E21B 21/062* (2013.01)

(58) Field of Classification Search
CPC ..... E21B 21/00; E21B 21/01; E21B 21/019; E21B 21/06–07
See application file for complete search history.

(56) References Cited

U.S. PATENT DOCUMENTS

| | | | | |
|---|---|---|---|---|
| 2,634,098 | A | 4/1953 | Armentrout | |
| 2,801,077 | A | 7/1957 | Howard et al. | |
| 3,028,913 | A | 4/1962 | Armentrout | |
| 4,347,002 | A * | 8/1982 | Born | B01F 31/441 366/334 |
| 5,814,230 | A | 9/1998 | Willis et al. | |
| 7,770,666 | B2 | 8/2010 | Allen | |
| 8,132,632 | B2 | 3/2012 | Scott | |
| 8,469,116 | B2 | 6/2013 | Larson | |
| 9,518,434 | B1 | 12/2016 | Champness et al. | |
| 10,612,325 | B2 | 4/2020 | Ye et al. | |
| 10,794,170 | B2 | 10/2020 | Cuellar et al. | |
| 2002/0108786 | A1 * | 8/2002 | Rowden | E21B 21/062 175/57 |
| 2007/0081866 | A1 | 4/2007 | Deal et al. | |
| 2009/0020336 | A1 | 1/2009 | Bohnsack et al. | |
| 2014/0116964 | A1 | 5/2014 | Bevan et al. | |
| 2016/0312551 | A1 * | 10/2016 | Rowe | E21B 7/00 |
| 2020/0291733 | A1 | 9/2020 | Van Kuilenburg et al. | |

FOREIGN PATENT DOCUMENTS

WO 2015130277 A1 3/2015

OTHER PUBLICATIONS

International Search Report and Written Opinion for PCT Application No. PCT/US2022/048646 dated Mar. 9, 2023.

* cited by examiner

*Primary Examiner* — Kristyn A Hall
(74) *Attorney, Agent, or Firm* — Bracewell LLP; Constance G. Rhebergen; Keith R. Derrington

(57) ABSTRACT

System and methods for delivering objects formed of a solid material into a circulation fluid of a subterranean well include a volume transfer container. The volume transfer container has an inlet port, an outlet port, and a charge access opening sized to provide for the filling of the volume transfer container with the objects. A discharge line extends from a pump assembly to the volume transfer container. A transfer line extends from the volume transfer container to the drilling assembly, providing a fluid flow path from the volume transfer container to the drilling assembly that is free of any pump.

15 Claims, 8 Drawing Sheets

DRILL STRING SOLIDS DEPLOYMENT

BACKGROUND OF THE DISCLOSURE

1. Field of the Disclosure

The present disclosure relates to subterranean developments, and more specifically, the disclosure relates to deploying solids within a subterranean well during drilling operations.

2. Description of the Related Art

During the drilling of subterranean wells, such as subterranean wells used in hydrocarbon development operations, drilling mud and other fluids can be pumped into the well. In certain drilling operations, the wellbore of the subterranean well can pass through a zone that has induced or natural fractures, are cavernous, or otherwise have an increased permeability, which is known as a lost circulation zone. In such a case, the drilling mud and other fluids that are pumped into the well can flow into the lost circulation zone and become irretrievable.

Lost circulation can be encountered during any stage of hydrocarbon development operations. Lost circulation can be identified when drilling fluid that is pumped into the subterranean well returns partially or does not return to the surface. While some fluid loss is expected, excessive fluid loss is not desirable from a safety, an economical, or an environmental point of view. Lost circulation can result in difficulties with well control, borehole instability, pipe sticking, unsuccessful production tests, poor hydrocarbon production after well completion, and formation damage due to plugging of pores and pore throats by mud particles. In extreme cases, lost circulation problems may force abandonment of a well.

SUMMARY OF THE DISCLOSURE

When unacceptable drilling fluid losses are encountered, conventional lost circulation materials are deployed with the drilling fluid from the surface. The revised fluid that includes the lost circulation materials is pumped downhole as part of the standard well circulation system. The revised fluid plugs and pressure seals the exposed formation at the point where losses are occurring. Once sealing has occurred and acceptable fluid loss control is established, drilling operations can resume. Conventional methods of delivering the revised fluid into the wellbore include passing the revised fluid through the standard charge pump. In some current systems the standard charge pump cannot accommodate objects within the revised fluid that are large, such as objects larger than 10 mm in diameter. In systems where the size of the objects will allow the objects to pass through the standard charge pump, the objects could still be damaged by the pumping or valve mechanism of the mud pumping system.

Embodiments of this disclosure provide systems and methods for downhole drill string deployment of large lost circulation or other large object, such as an object larger than 10 mm in diameter, that cannot pass through a standard charge pump or mud circulation pump. Such pumps can be, for example, centrifugal or positive displacement pumps. The systems and methods of this disclosure may also be used where objects can pass through the pumping system, but may become damaged by the associated pumping or valve mechanisms.

In an embodiment of this disclosure, a system for delivering objects formed of a solid material into a circulation fluid of a subterranean well includes a drilling assembly having a drill string that extends into the subterranean well. The drill string has a central bore defining an interior portion of a fluid flow path for the circulation fluid. An annulus is located between an outer diameter surface of the drill string and an inner diameter surface of the subterranean well. The annulus defines an annular portion of the fluid flow path for the circulation fluid. A mud tank is in fluid communication with the annuls by way of a mud return line, the mud tank having a storage space for the circulation fluid. A pump assembly is in fluid communication with the mud tank by way of a suction line. The pump assembly is operable to draw fluids from the mud tank through the suction line. A discharge line extends from the pump assembly to a volume transfer container. The volume transfer container has an inlet port, an outlet port, and a charge access opening sized to provide for the filling of the volume transfer container with the objects. A transfer line extends from the volume transfer container to the drilling assembly, providing a fluid flow path from the volume transfer container to the drilling assembly that is free of any pump.

In alternate embodiments, the outlet port of the volume transfer container can be in selective fluid communication with the transfer line. The inlet port can be in selective communication with a pump output. The pump output can be a high pressure pump output of the pump assembly. Alternately, the pump output can be a low pressure pump output of a low pressure pump.

In other alternate embodiments, the volume transfer container can be a tank containing a baffle labyrinth located between the inlet port and the outlet port. Alternately, the volume transfer container can be a tank containing an internal piston assembly with a piston head operable to move in a direction from the inlet port towards the outlet port. Alternately, the volume transfer container can be a pipe assembly containing one or more tubular members secured in line with both the discharge line and the transfer line.

In an alternate embodiment of this disclosure, a method for delivering objects formed of a solid material into a circulation fluid of a subterranean well includes extending a drill string of a drilling assembly into the subterranean well. The drill string has a central bore defining an interior portion of a fluid flow path for the circulation fluid, and defines an annulus located between an outer diameter surface of the drill string and an inner diameter surface of the subterranean well. The annulus defines an annular portion of the fluid flow path for the circulation fluid. The method further includes circulating the circulation fluid into the subterranean well with a circulation system. The circulation system includes a mud tank in fluid communication with the annuls by way of a mud return line. The mud tank has a storage space for the circulation fluid. A pump assembly is in fluid communication with the mud tank by way of a suction line. The pump assembly draws fluids from the mud tank through the suction line. A discharge line extends from the pump assembly to a volume transfer container. The volume transfer container has an inlet port, an outlet port, and a charge access opening sized to provide for the filling of the volume transfer container with the objects. A transfer line extends from the volume transfer container to the drilling assembly, providing a fluid flow path from the volume transfer container to the drilling assembly that is free of any pump.

In alternate embodiments, the method can further include circulating circulation fluid out of the volume transfer container through the outlet port to the transfer line and into the central bore of the drill string. Circulation fluid can be pumped into the volume transfer container from a pump output into the inlet port of the volume transfer container. The pump output can be a high pressure pump output of the pump assembly. Alternately, The pump output can be a low pressure pump output of a low pressure pump.

In other alternate embodiments, the volume transfer container can be a tank containing a baffle labyrinth located between the inlet port and the outlet port, and the method can further includes sweeping the circulation fluid through the baffle labyrinth and out of the outlet port. Alternately, the volume transfer container can be a tank containing an internal piston assembly with a piston head, and the method can further include sweeping the circulation fluid out of the outlet port by moving the piston head in a direction towards the outlet port. Alternately, the volume transfer container can be a pipe assembly containing one or more tubular members secured in line with both the discharge line and the transfer line, and the method can further include sweeping the circulation fluid out of the outlet port of the pipe assembly.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments that are illustrated in the drawings that form a part of this specification. It is to be noted, however, that the appended drawings illustrate only certain embodiments of the disclosure and are not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
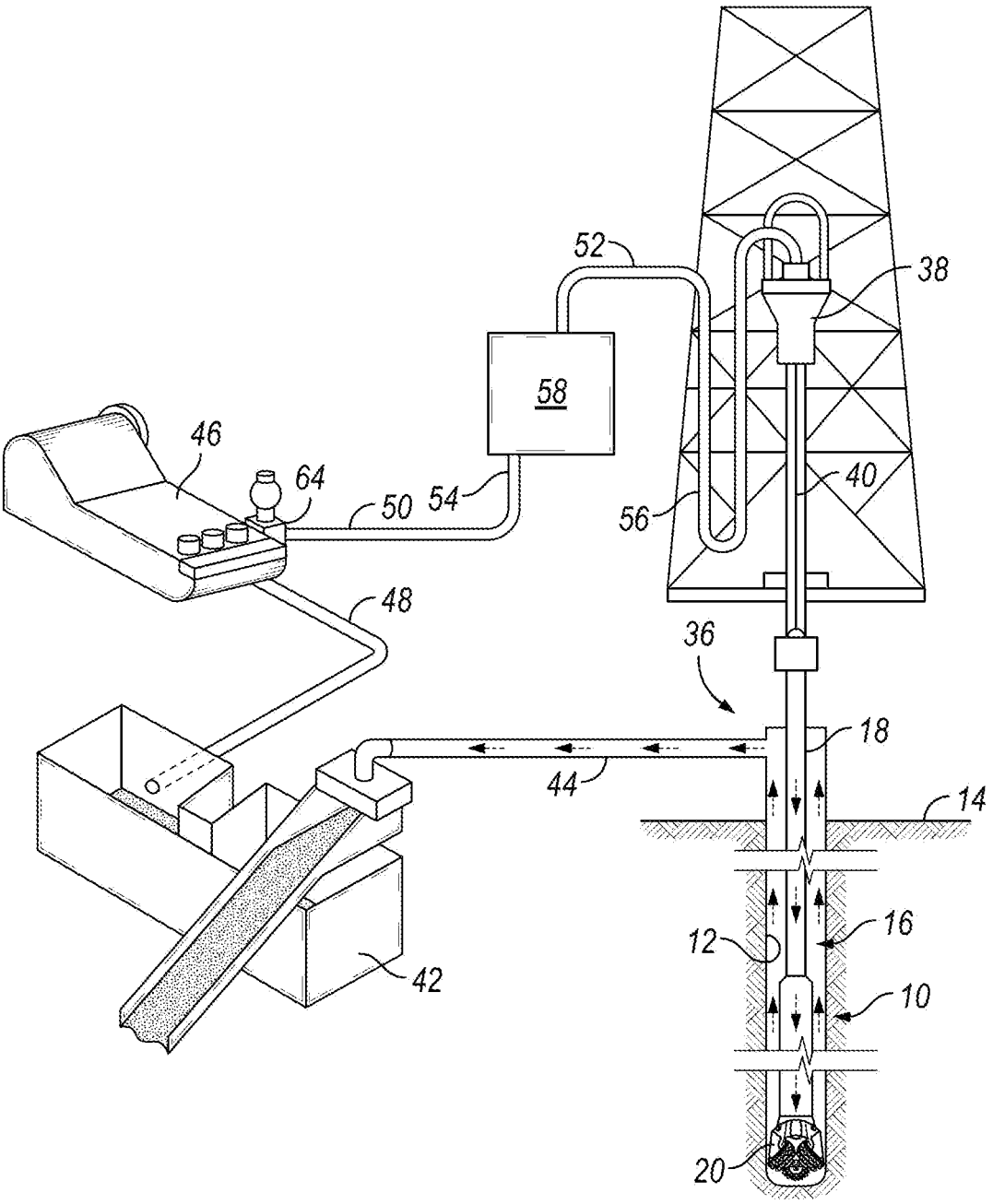
FIG. 1 is a schematic perspective subterranean well development operation, with a system for delivering objects formed of a solid material into a circulation fluid of a subterranean well, in accordance with an embodiment of this disclosure.

Looking at FIG. 1, subterranean well 10 can have wellbore 12 that extends to an earth's surface 14. Subterranean well 10 can be an offshore well or a land based well, and can be used for producing hydrocarbons from subterranean hydrocarbon reservoirs. Drill string 16 can be delivered into and located within wellbore 12. Drill string 16 can include tubular member 18 and bottom hole assembly 20. Tubular member 18 can extend from surface 14 into subterranean well 10. Bottom hole assembly 20 can include, for example, drill collars, stabilizers, reamers, shocks, a bit sub and the drill bit. Drill string 16 can be used to drill wellbore 12. In certain embodiments, tubular member 18 is rotated to rotate the bit to drill wellbore 12.

Figure 2:
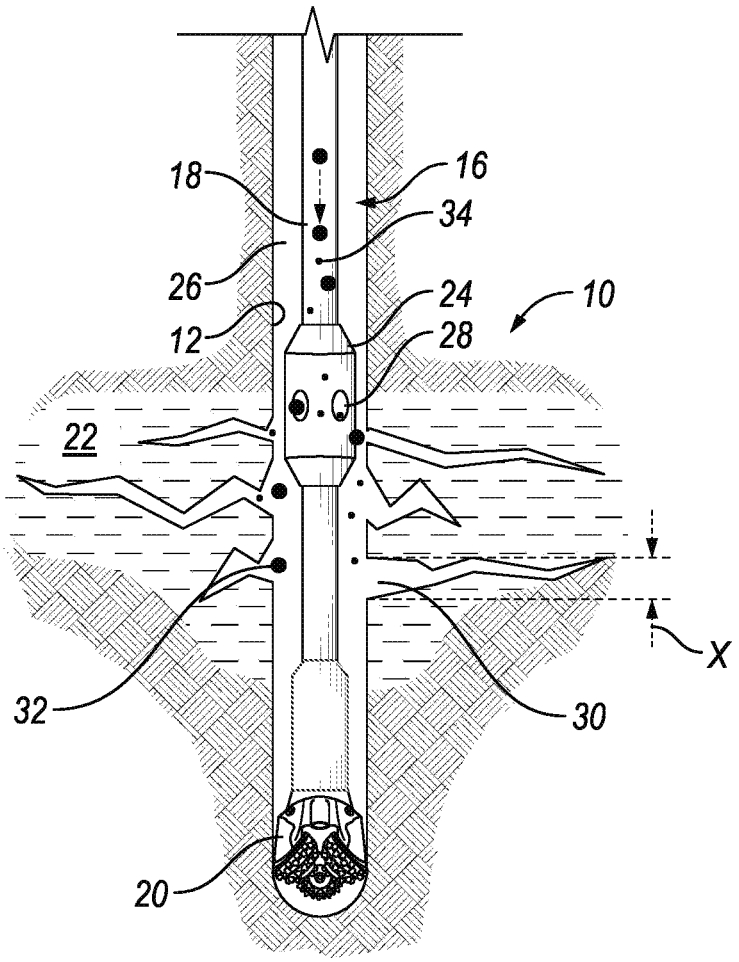
FIG. 2 is a section view of a subterranean well showing the delivery of lost circulation shapes and lost circulation material to a lost circulation zone, in accordance with an embodiment of this disclosure.

Looking at FIG. 2, wellbore 12 can be drilled through lost circulation zone 22. In certain embodiments lost circulation zone 22 is a layer of a subterranean formation that is located uphole of a hydrocarbon formation, downhole of a hydrocarbon formation, or between separate hydrocarbon formations. In certain embodiments, drill string 16 can pass through a cased section of wellbore 12 of subterranean well 10 in order to reach uncased open hole portion of wellbore 12.

A system for sealing lost circulation zone 22 associated with subterranean well 10 includes a circulating port to provide downhole fluid circulation. The circulating port provides fluid communication between an inner bore of drill string 16 and annulus 26.

Annulus 26 is the elongated annular shaped space that extends a length of drill string 16 and is defined between an outer diameter surface of drill string 16 and an inner diameter surface of wellbore 12 of subterranean well 10. Annulus 26 defines an annular portion of the fluid flow path for the circulation fluid. Drill string 16 has a central bore defining an interior portion of a fluid flow path for the circulation fluid. During downhole fluid circulation, fluids can flow downhole through the inner bore of drill string 16 and uphole through annulus 26. In reverse circulation, fluids can flow downhole through annulus 26 and uphole through the inner bore of drill string 16.

In the example embodiment of FIG. 2, drill string 16 can include circulating sub 24. Circulating sub 24 can be a circulating sub known and commonly available in the industry for circulating fluids downhole. Circulating sub 24 can include circulating sub port 28, which is one of a number of possible circulating ports. Circulating sub port 28 extends through a sidewall of circulating sub 24 and provides fluid communication between the inner bore of drill string 16 and annulus 26. In alternate embodiments, bottom hole assembly 20 can include the circulating port.

The system for sealing lost circulation zone 22 can be used to seal the entry of cavity 30 of lost circulation zone that has a cross sectional dimension X that is too large to be sealed with some currently available lost circulation material. Cavity 30 can be, for example, vugular or cavernous faults. After bottom hole assembly 20 has reached or passed through lost circulation zone 22, a combination of lost circulation shape 32 and lost circulation material 34 can be used to seal cavities 30 of lost circulation zone 22.

In the example embodiment of FIG. 2, lost circulation shape 32 and lost circulation material 34 are made part of circulation fluid which is pumped in a direction downhole through drill string 16, and exits circulating sub port 28 to reach annulus 26 for delivery to lost circulation zone 22. In the example embodiment of FIG. 1, the circulation fluid is pumped in a direction downhole through drill string 16, and exits a through a circulating port of bottom hole assembly 20 to reach annulus 26 for delivery to lost circulation zone 22.

In the embodiment of FIG. 1, a system for delivering objects formed of a solid material into a circulation fluid of a subterranean well 10 includes drilling assembly 36. Drilling assembly 36 includes swivel 38, Kelly 40, drill string 16, bottom hole assembly 20. In alternate embodiments, instead of swivel a top drive can be used and no Kelly is included.

Mud tank 42 is in fluid communication with annulus 26 by way of return line 44. Return line 44 caries circulation fluid and solids, including objects, to mud tank 42 after the circulation fluid has been circulated through subterranean well 10. Mud tank 42 is sized to provide storage space for the circulation fluid. Mud tank 42 can be associated with a shale shaker, which can be a vibrating screen device for screening cutting and other solids from the circulation fluid. The circulation fluid can drain into mud tank 42 from the shale shaker to be recirculated into subterranean well 10.

Pump assembly 46 is in fluid communication with mud tank 42 by way of suction line 48. Pump assembly 46 can draw circulation fluids from mud tank 42 and provide sufficient pressure for pumping the circulation fluids back into subterranean well 10. Pump assembly 46 is includes a high pressure pump and has a high pressure pump output 64. As an example, the high pressure pump of pump assembly 46 can have a pressure of up to 7,500 pounds per square inch (psi).

Discharge line 50 extends from pump assembly for delivery of circulation fluids to subterranean well 10. Transfer line 52 extends to drilling assembly 36. Discharge line 50 and transfer line 52 can both include, for example, portions of a standpipe 54. Transfer line 52 can further include rotary hose 56.

Volume transfer container 58 is shown schematically in FIG. 1. Volume transfer container 58 can be part of a system that is mounted on an independent skid. Such skid can contain, for example, a low pressure charge pump or intermediate pump, flow control valves, monitoring sensors and any other equipment or tools required for the operation of volume transfer container 58. Alternately, volume transfer container 58 can be a standalone container free of a skid.

Discharge line 50 extends from pump assembly 46 to volume transfer container 58. Transfer line 52 extends from volume transfer container 58 to drilling assembly 36. Where discharge line 50 and transfer line 52 both include parts of standpipe 54, then volume transfer container 58 is located along standpipe 54. Transfer line 52 provides a fluid flow path from volume transfer container 58 to drilling assembly 36 that is free of any pump. In alternate embodiments, volume transfer container 58 can be secured in line along mud circulating pipe work upstream of standpipe 54.

Figure 3:
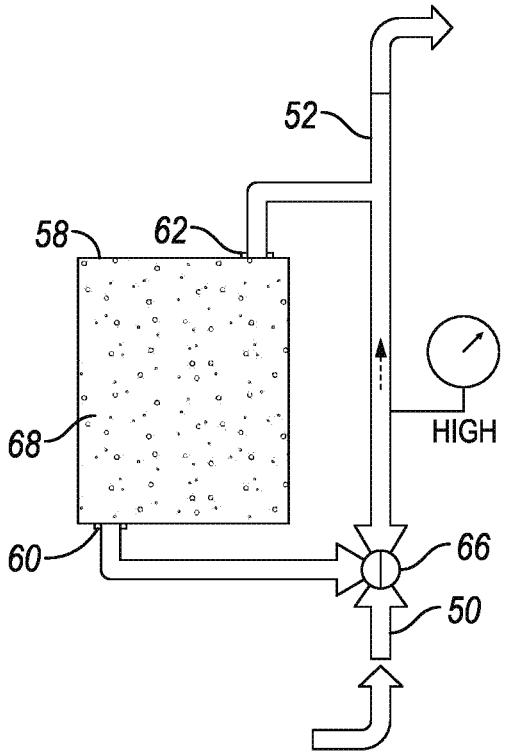
FIGS. 3-4 are schematic section views of volume transfer container of a system for delivering objects formed of a solid material into a circulation fluid of a subterranean well, in accordance with an embodiment of this disclosure.
Figure 4:
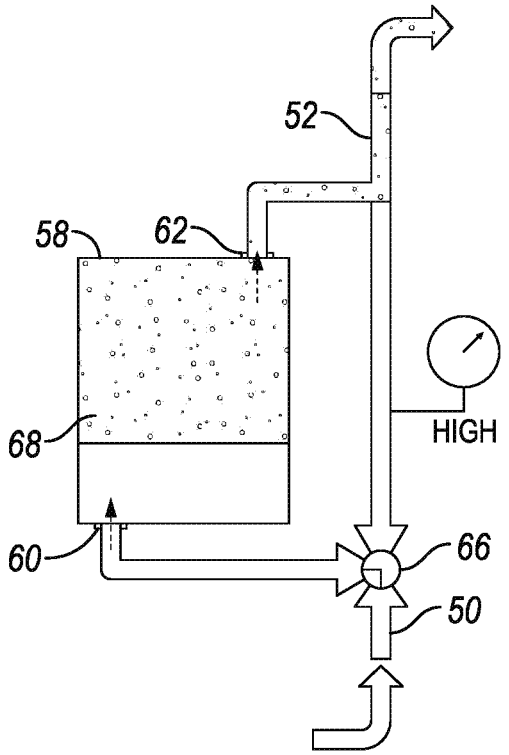

Looking at FIGS. 3 to 4, volume transfer container 58 includes inlet port 60 and outlet port 62. Outlet port 62 of volume transfer container 58 is in communication with transfer line 52 so that circulation fluid and any solids added to circulation fluid flow out of outlet port 62 to transfer line 52.

In certain embodiments, such as the embodiment of FIGS. 3-4, inlet port 60 of volume transfer container 58 is in selective communication with high pressure pump output 64 of pump assembly 46. In other embodiments, as is further explained in this disclosure, inlet port 60 of volume transfer container 58 is in selective communication with a pump output of another pump. Inlet valve 66 can be operated to control the flow of fluids from discharge line 50 into inlet port 60. Inlet valve 66 can be a flow direction valve that can be operated to change the direction of the flow of fluids through inlet valve 66.

Looking at FIG. 3, during drilling operations where objects 68 contained in volume transfer container 58, such as, for example lost circulation material are not being added to circulation fluids for delivery into wellbore 12, inlet valve 66 can be positioned so that circulation fluids in discharge line 50 do not enter inlet port 60. In such an embodiment, circulation fluids from pump assembly 46 bypass volume transfer container 58 and travel to transfer line 52 for circulation into wellbore 12.

There may be times when the delivery of objects 68 that are formed of solid material are required to be delivered into wellbore 12, such as for example, upon the occurrence of severe or total lost circulation. Looking at FIG. 4, when objects 68 contained in volume transfer container 58 are to be added to the circulation fluids for circulation within wellbore 12, inlet valve 66 can be repositioned so that circulation fluids from discharge line 50 travel through inlet port 60 and into volume transfer container 58. The repositioning of inlet valve can occur, for example, when pump assembly 46 (FIG. 1) is off, such as when a drill pipe connection is being made up.

After pump assembly 46 is turned back on, because discharge line 50 and inlet valve 66 are in fluid communication with high pressure pump output 64 of pump assembly 46 (FIG. 1), circulation fluids pass into volume transfer container 58 at high pressure. As the circulation fluids pass into and through volume transfer container 58, objects 68 that were contained within volume transfer container 58 are carried out of volume transfer container 58 through outlet port 62 and into transfer line 52 for delivery into wellbore 12.

Because volume transfer container 58 in such an embodiment is subjected to high pressure pump output 64 of pump assembly 46, volume transfer container 58 and associated valves and connections will be pressure rated and protected, such as with pressure relief valves, to the maximum pressure capacity of pump assembly 46.

Looking at FIG. 1, because transfer line 52 is free of any pumps, objects 68 are delivered into wellbore 12 using the embodiment of FIGS. 3-4 without passing through any pumps. In this way objects 68 can be sized bigger than a size of solid material that would be able to pass through pump assembly 46 and will not be at risk of being damaged by travelling through a pump. After the required volume of fluid and objects 68 has been transferred out of volume transfer container 58, pump assembly 46 can be stopped and inlet valve 66 can be again positioned so that circulation fluids in discharge line 50 do not enter inlet port 60, as shown in FIG. 3. Volume transfer container 58 can be refilled with objects 68 and the method of FIGS. 3-4 can be repeated as required.

Figure 5:
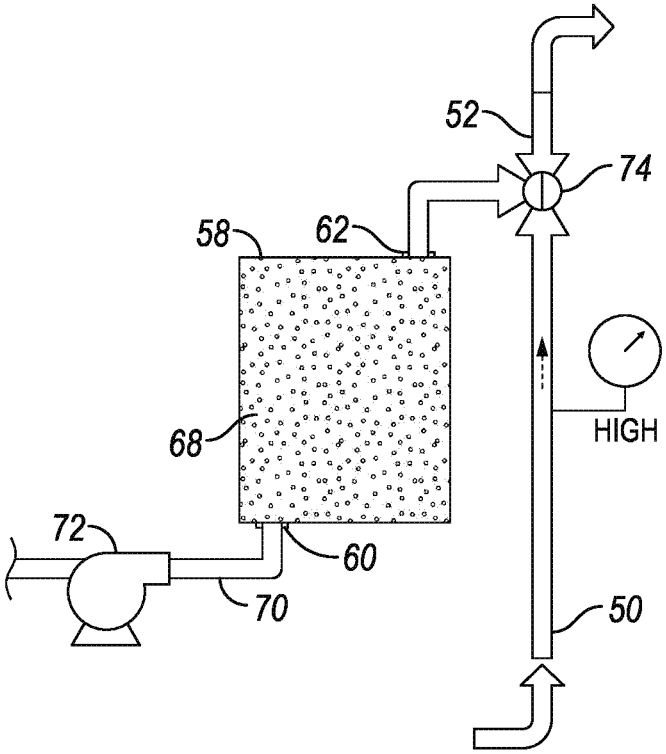
FIGS. 5-6 are schematic section views of an alternate volume transfer container of a system for delivering objects formed of a solid material into a circulation fluid of a subterranean well, in accordance with an embodiment of this disclosure.
Figure 6:
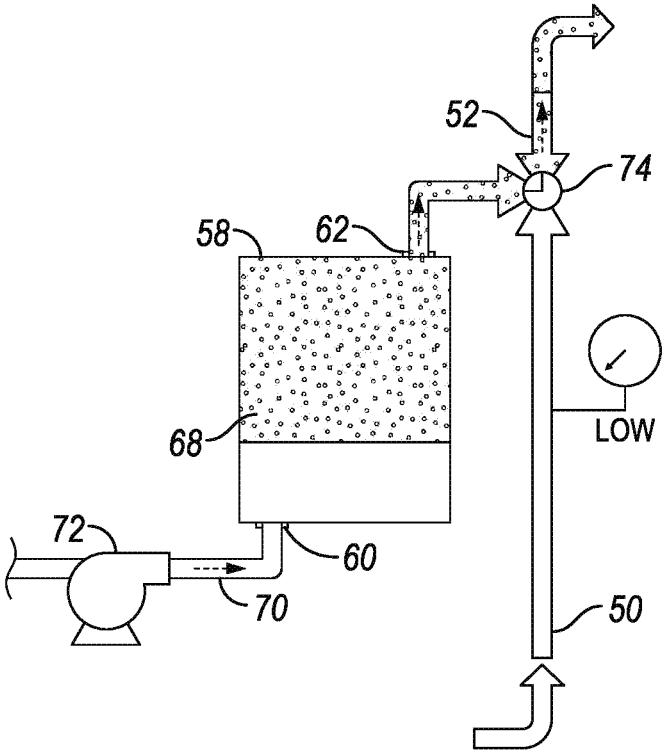

In an alternate embodiment, looking at FIGS. 5-6, volume transfer container 58 includes inlet port 60 and outlet port 62. Outlet port 62 of volume transfer container 58 is in selective communication with transfer line 52 so that circulation fluid and any solids added to circulation fluid flow out of outlet port 62 to transfer line 52.

In the embodiments of FIGS. 5-6, inlet port 60 of volume transfer container 58 is in communication with charge line 70. Charge line 70 can be in communication with a pump output of charge pump 72. In the embodiment of FIGS. 5-6, charge pump 72 is a low pressure pump providing a low pressure output. As an example, a low pressure pump of charge pump 72 can have a pressure of up to 500 psi. In alternate embodiments, charge pump 72 can be a high pressure pump. As an example, a high pressure pump of charge pump 72 can have a pressure of up to 7,500 psi.

Looking at FIG. 5, during drilling operations where objects 68 contained in volume transfer container 58, such as, for example lost circulation material are not being added to circulation fluids for delivering into wellbore 12, outlet valve 74 can be positioned so that circulation fluids and objects 68 in volume transfer container 58 do not exit outlet port 62. Outlet valve 74 can be a flow direction valve that can be operated to change the direction of the flow of fluids through outlet valve 74. In such an embodiment, circulation fluids from pump assembly 46 travel to transfer line 52 for circulation into wellbore 12 without being mixed with fluids and objects 68 in volume transfer container 58.

There may be times when the delivery of objects 68 are required to be delivered into wellbore 12, such as for example, upon the occurrence of severe or total lost circulation. Looking at FIG. 6, when objects 68 contained in volume transfer container 58 are to be added to the circulation fluids for circulation within wellbore 12, outlet valve 74 can be repositioned so that circulation fluids and objects 68 in volume transfer container 58 exit out of outlet valve 74 and into transfer line 52. The repositioning of outlet valve 74 can occur, for example, when pump assembly 46 (FIG. 1) is off, such as when a drill pipe connection is being made up.

Charge pump 72 can pump circulation fluids into volume transfer container 58 that is free of objects 68 to flush objects 68 out of volume transfer container 58. Objects 68 that were contained within volume transfer container 58 are carried out of volume transfer container 58 through outlet port 62 and into transfer line 52 for delivery into wellbore 12.

Looking at FIG. 1, because transfer line 52 is free of any pumps, objects 68 are delivered into wellbore 12 using the embodiment of FIGS. 5-6 without passing through any pumps. In this way objects 68 can be sized bigger than a size of solid material that would be able to pass through pump assembly 46 and will not be at risk of being damaged by travelling through a pump. After the required volume of fluid and objects 68 has been transferred out of volume transfer container 58, pump assembly 46 can be stopped and outlet valve 74 can be again positioned so that circulation fluids and objects 68 in volume transfer container 58 do not exit outlet port 62, as shown in FIG. 5. Volume transfer container 58 can be refilled with objects 68 and the method of FIGS. 5-6 can be repeated as required.

In the embodiment of FIGS. 5-6, the low pressure components of the system are protected by high pressure valves when the low pressure components are not in use. A control system can monitor pressures within the transfer system and within the other components of the circulation system and can actuate high pressure valves when appropriate to prevent high pressure fluids entering the low pressure transfer pipework.

Figure 9:
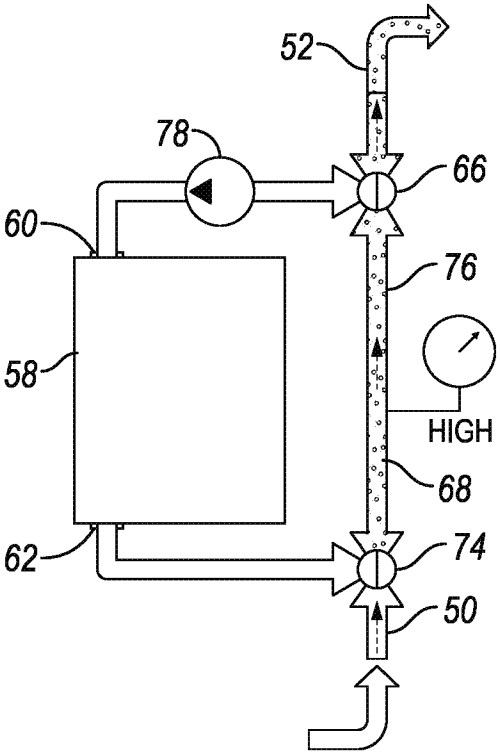
FIGS. 7-9 are schematic section views of another alternate volume transfer container of a system for delivering objects formed of a solid material into a circulation fluid of a subterranean well, in accordance with an embodiment of this disclosure.
Figure 8:
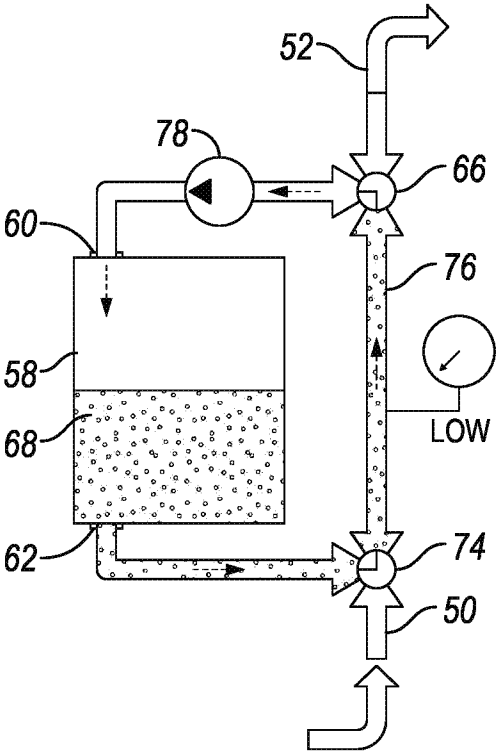
Figure 7:
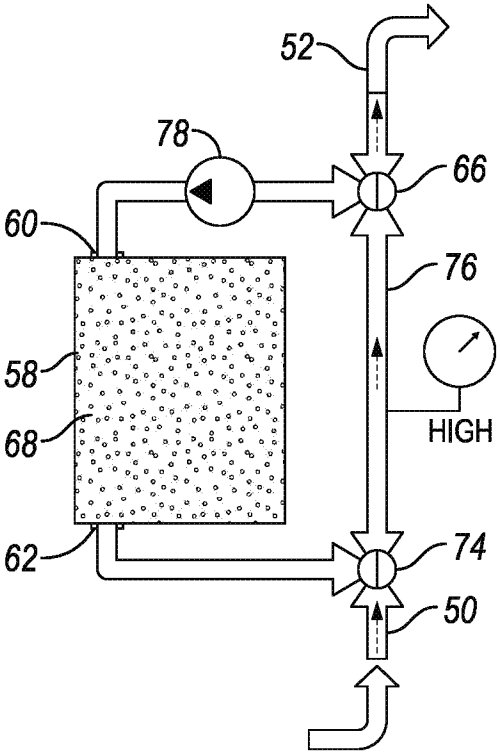

In other alternate embodiments, looking at FIGS. 7-9, volume transfer container 58 includes inlet port 60 and outlet port 62. Outlet port 62 of volume transfer container 58 is in communication selective with transfer line 52 by way of intermediate line 76 so that circulation fluid and any solids added to circulation fluid flow out of outlet port 62 and through intermediate line 76 to transfer line 52.

In the embodiment of FIGS. 7-9, inlet port 60 of volume transfer container 58 is in communication with a pump output of intermediate pump 78. In the embodiment of FIGS. 7-9, intermediate pump 78 is a low pressure pump providing a low pressure output. As an example, a low pressure pump of intermediate pump 78 can have a pressure of up to 500 psi. In alternate embodiments, intermediate pump 78 can be a high pressure pump. As an example, a high pressure pump of intermediate pump 78 can have a pressure of up to 7,500 psi.

Inlet valve 66 can be operated to control the flow of fluids from discharge line 50 into inlet port 60. Outlet valve 74 can be operated to control the flow of fluids and objects 68 from volume transfer container 58 to intermediate line 76. Both inlet valve 66 and outlet valve 74 can be flow direction valves.

Looking at FIG. 7, during drilling operations where objects 68 contained in volume transfer container 58, such as, for example lost circulation material are not being added to circulation fluids for delivery into the wellbore 12, inlet valve 66 and outlet valve 74 can be positioned so that circulation fluids in discharge line 50 and in intermediate line 76 do not enter inlet port 60. In such an embodiment, circulation fluids from pump assembly 46 (FIG. 1) bypass volume transfer container 58 and travel to transfer line 52 for circulation into wellbore 12.

Looking at FIG. 8, in order to prepare objects 68 contained in volume transfer container 58 for being added to the circulation fluids for circulation within wellbore 12, inlet valve 66 can be positioned so that circulation fluids from intermediate line 76 are directed towards intermediate pump 78. Outlet valve 74 can be positioned so that fluids and objects 68 within volume transfer container 58 can flow into intermediate line 76. The repositioning of inlet valve 66 and outlet valve 74 can occur, for example, when pump assembly 46 (FIG. 1) is off, such as when a drill pipe connection is being made up.

Intermediate pump 78 can then be used to pump circulation fluid that was previously located within intermediate line 76 into volume transfer container, displacing fluids and objects 68 that were within volume transfer contain so that such fluids and objects flow into intermediate line 76. As can be seen in FIG. 8, this is a closed loop circulation.

In the embodiment of FIG. 8, this batch charging of intermediate line 76 with objects 68 occurs at low pressure by using intermediate pump 78 that has a low pressure output. As an example, intermediate pump 78 can be a large chamber positive displacement pump. In alternative embodiments, intermediate pump 78 can be a conventional pump. Alternately, instead of using intermediate pump 78, and accumulator can push an internal piston to sweep the contents of volume transfer container 58 out outlet valve 74.

Looking at FIG. 9, in order to deliver fluids and objects 68 from volume transfer container 58, inlet valve 66 and outlet valve 74 can be repositioned so that circulation fluids in intermediate line 76 no longer enter inlet port 60. The fluids and objects 68 that are now contained within intermediate line 76 travel to transfer line 52 for circulation into wellbore 12 by a high pressure pump of pump assembly 46. After the fluid and objects 68 that were contained within intermediate line 76 are delivered into wellbore 12, circulation fluids from pump assembly 46 (FIG. 1) bypass volume transfer container 58 and travel to transfer line 52 for circulation into wellbore 12.

Looking at FIG. 1, because transfer line 52 is free of any pumps, objects 68 are delivered into wellbore 12 using the embodiment of FIGS. 7-9 without passing through any pumps. In this way objects 68 can be sized bigger than a size of solid material that would be able to pass through pump assembly 46 and will not be at risk of being damaged by travelling through a pump. After the required volume of fluid and objects 68 has been transferred out of volume transfer container 58, pump assembly 46 can be stopped. Inlet valve 66 can be positioned so that circulation fluids from intermediate line 76 are directed towards intermediate pump 78 and outlet valve 74 can be positioned so that fluids and objects 68 within volume transfer container 58 can flow into intermediate line 76, as shown in FIG. 7. Volume transfer container 58 can be refilled with objects 68 and the method of FIGS. 7-9 can be repeated as required.

In embodiments of this disclosure, volume transfer container 58 can be a tank. Volume transfer container 58 has a charge access opening sized to provide for the filling of volume transfer container 58 with objects 68. In embodiments where volume transfer container 58 is a tank, the tank can have tank lid 82 that can be used as the charge access opening for filling volume transfer container 58 with liquids and objects 68. Tank lid 82 can be pressure rated and can be removable or hinged.

The tank can alternately have charge port 84. Charge port 84 can be an opening through a sidewall of the tank. Charge port 84 can also be sized so that charge port 84 can used as the charge access opening for filling volume transfer container 58 with objects 68.

Figure 10C:
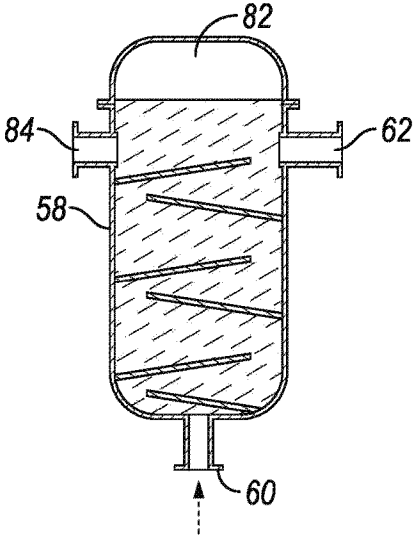
FIGS. 10A-10C are section views of a tank embodiment of a volume transfer container of a system for delivering objects formed of a solid material into a circulation fluid of a subterranean well, in accordance with an embodiment of this disclosure.
Figure 10B:
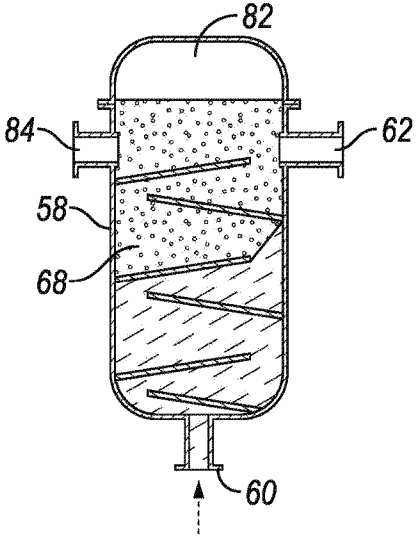
Figure 10A:
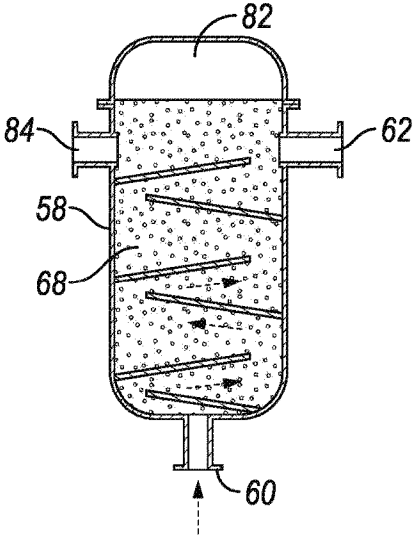

Looking at FIGS. 10A-10C, in order to maximize the amount of liquids and objects 68 that is swept out of volume transfer container 58, volume transfer container 58 can include baffle labyrinth 80 located between inlet port 60 and outlet port 62. Baffle labyrinth 80 is of particular use when volume transfer container 58 is a tank. Baffle labyrinth 80 includes a series of plates that extend radially inward from an interior surface of the tank. Baffle labyrinth 80 defines a zig zag shaped flow path between inlet port 60 and outlet port 62. Because the flow of fluids and objects 68 is through a defined path, the circulation fluid used to flush the liquids and objects 68 can more effectively sweep such liquid and objects 68 out of volume transfer container 58 with less mixing of the circulation fluid with the liquids and objects 68.

Looking at FIG. 10A, volume transfer container 58 is filled with liquid and objects 68. Looking at FIG. 10B, as the circulation fluid is delivered into inlet port 60, the liquid and objects 68 are swept through baffle labyrinth 80 towards outlet port 62. Looking at FIG. 10C, after the liquid and objects 68 have been swept out of volume transfer container 58, volume transfer container 58 will be filled with the circulation fluid.

Figure 11C:
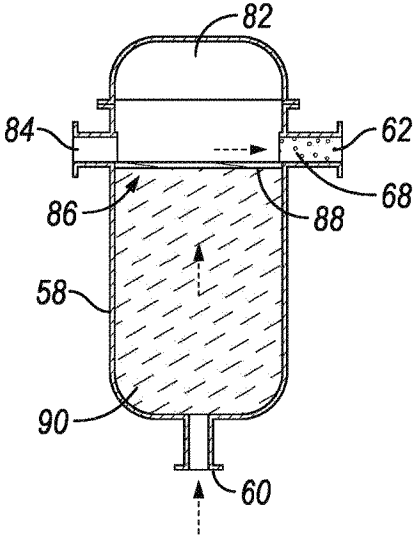
FIGS. 11A-11C are section views of an alternate tank embodiment of a volume transfer container of a system for delivering objects formed of a solid material into a circulation fluid of a subterranean well, in accordance with an embodiment of this disclosure.
Figure 11B:
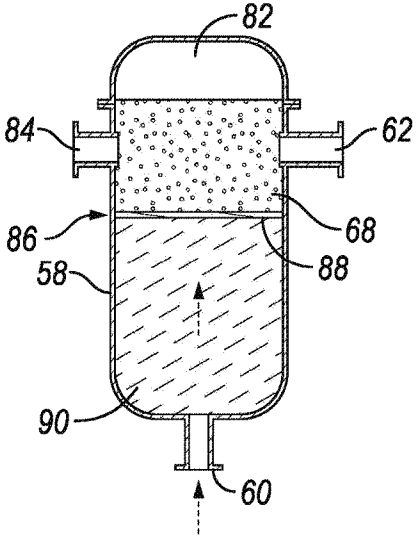
Figure 11A:
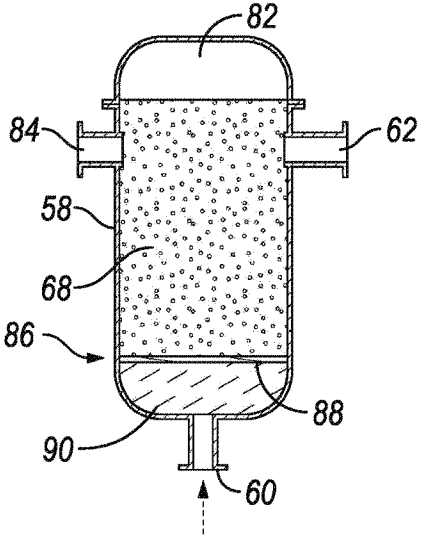

Looking at FIGS. 11A-11C, alternately, in order to maximize the amount of liquids and objects 68 that is swept out of volume transfer container 58, volume transfer container 58 can include internal piston assembly 86 with piston head 88. Piston head 88 can be a disk shaped member that sealingly engages the inner diameter surface of volume transfer container 58. Piston head 88 can move in a direction from inlet port 60 towards outlet port 62. A pressure fluid 90 can be delivered into inlet port 60. Pressure fluid 90 can cause piston head 88 to move towards outlet port 62, pushing the liquid and objects 68 stored within volume transfer container 58 out of volume transfer container 58 through outlet port 62. In embodiments with piston assembly 86, liquid and objects 68 are pushed out of volume transfer container 58 with no mixing of the pressure fluid with the liquids and objects 68.

Looking at FIG. 11A, volume transfer container 58 is filled with liquid and objects 68. Looking at FIG. 11B, as the pressure fluid is delivered into inlet port 60, the liquid and objects 68 are pushed out outlet port 62. Looking at FIG. 11C, after piston head 88 reaches the elevation of outlet port 62, circulation fluid or other fluid can be delivered through charge port 84 to sweep any remaining liquids and objects 68 out of outlet port 62.

Figure 12C:
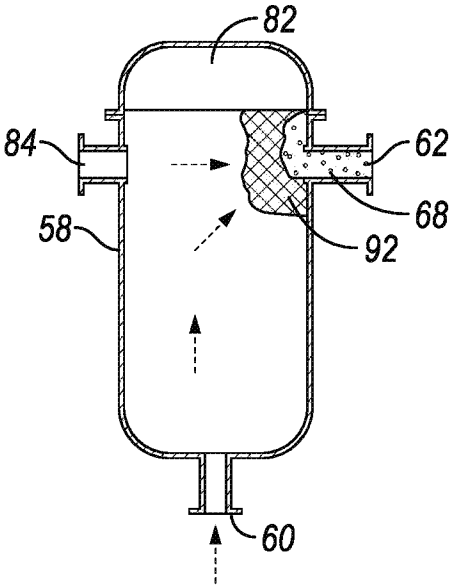
FIGS. 12A-12C are section views of another alternate tank embodiment of a volume transfer container of a system for delivering objects formed of a solid material into a circulation fluid of a subterranean well, in accordance with an embodiment of this disclosure.
Figure 12B:
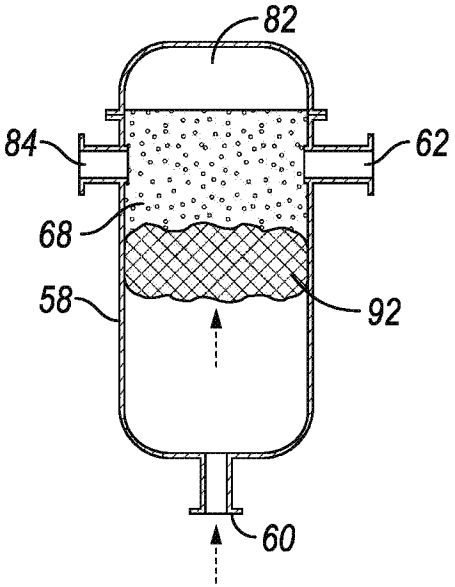
Figure 12A:
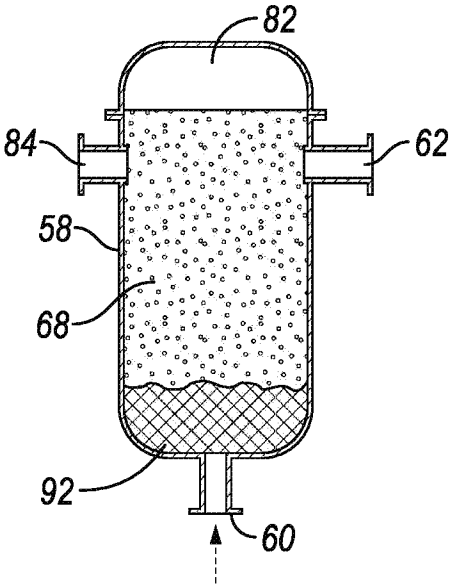

Looking at FIGS. 12A-12C, alternately, in order to maximize the amount of liquids and objects 68 that is swept out of volume transfer container 58, viscous pill 92 can be delivered into inlet port 60. Viscous pill 92 can be, for example, a gel or other liquid with a higher viscosity than the liquids in volume transfer container 58. As viscous pill 92 is delivered into inlet port 60, the liquid and objects 68 stored within volume transfer container 58 are swept out of volume transfer container 58 through outlet port 62. In embodiments with viscous pill 92, liquid and objects 68 are pushed out of volume transfer container 58 with little mixing of viscous pill 92 or the circulation fluids delivered after viscous pill 92, with the liquids and objects 68.

Looking at FIG. 12A, volume transfer container 58 is filled with liquid and objects 68. Looking at FIG. 12B, as viscous pill 92 is delivered into inlet port 60, the liquid and objects 68 contained within volume transfer container 58 are pushed out outlet port 62. Viscous pill 92 can be moved through volume transfer container 58 by delivering circulation fluids or another fluid into inlet port 60 after viscous pill 92. Looking at FIG. 12C, after viscous pill 92 reaches the elevation of outlet port 62, circulation fluid or other fluid can be delivered through charge port 84 to push viscous pill 92 towards outlet port 62, sweeping any remaining liquids and objects 68 out of outlet port 62.

Figure 13:
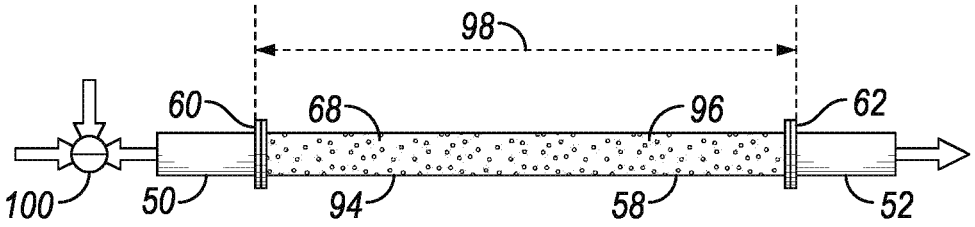
FIG. 13 is a section view of a pipe assembly embodiment of a volume transfer container of a system for delivering objects formed of a solid material into a circulation fluid of a subterranean well, in accordance with an embodiment of this disclosure.

Looking at FIG. 13, in other alternate embodiments, volume transfer container 58 can be pipe assembly 94 containing one or more tubular members 96 secured in line with both discharge line 50 and transfer line 52. In such embodiments, liquids and objects 68 can be contained within tubular member 96. Tubular member 96 will have an inner diameter that allows an open end of tubular member 96 to be a charge access opening. That is, liquids and objects 68 can be delivered into tubular member 96 through an open end of tubular member 96 so that tubular member 96 is filled with liquid and objects 68 to be delivered to wellbore 12.

As shown in FIG. 13, tubular member 96 can have a standard length 98 between mating flange faces. In this way, tubular member 96 can be removed and replaced with another tubular member that contains more of the same or a different combination of fluids and solids for delivering into wellbore 12.

Figure 14A:
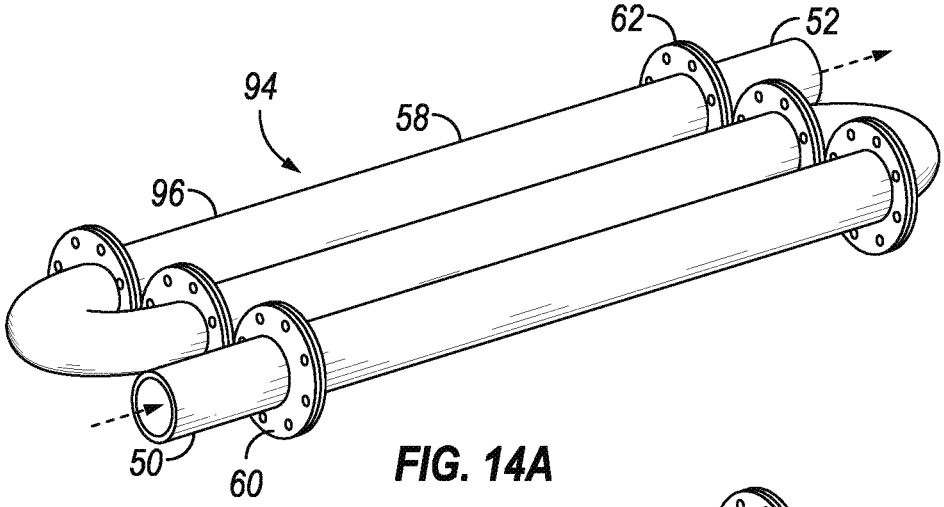
FIG. 14A-14C are perspective views of alternate embodiments of pipe assembly embodiments of a volume transfer container of a system for delivering objects formed of a solid material into a circulation fluid of a subterranean well, in accordance with an embodiment of this disclosure.
Figure 14B:
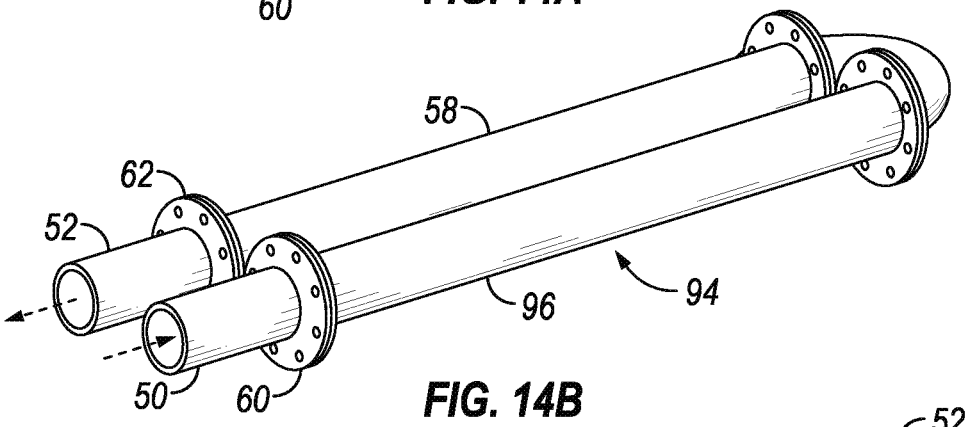
Figure 14C:
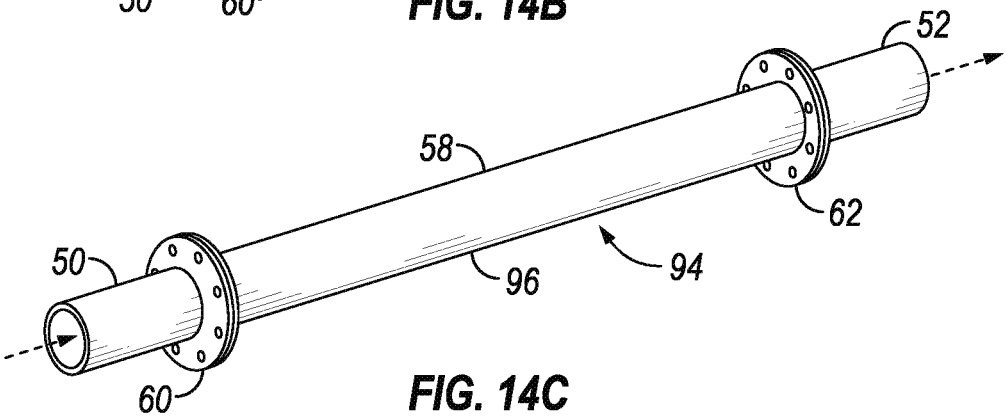

Looking at FIGS. 14A-14C, pipe assembly 94 can include a single tubular member 96 (FIG. 14C). Pipe assembly 94 can alternately include two tubular members 96 (FIG. 14B). In the embodiment with two tubular members 96, pipe assembly 94 will have a one hundred and eighty degree change in the direction of the flow of fluids through pipe assembly 94 so that the direction of the flow of fluid in discharge line 50 is in the opposite direction of the fluid of fluid in transfer line 52. Pipe assembly 94 can alternately have three or more tubular members 96 (FIG. 14A). In such an embodiment, pipe assembly 94 will the change in the direction of the flow of fluids through pipe assembly 94 will change by one hundred and eighty degrees with each additional tubular member 96 greater than one.

Looking at FIG. 13, pipe assembly 94 can further include charge valve 100. Charge valve 100 can be used to add new liquids and objects 68 to tubular member 96. An advantage of using pipe assembly 94 is that the number of tubular members 96 can be adjusted to vary the volume of volume transfer container 58. In addition the different tubular members 96 can be filled with different fluids and objects 68 and such tubular members 96 can be added, removed, or switched to address different situations encountered during the drilling operations.

Example embodiments of this disclosure show volume transfer container 58 as a tank or a pipe. In alternate embodiments, volume transfer container 58 can be a feed hoppers or a mobile tanker.

In an example of operation, a method for delivering objects 68 formed of a solid material into a circulation fluid of subterranean well 10 includes extending drill string 16 into wellbore 12. During drilling operations, if there is a severe or total loss of circulation fluids, an operator can determine that it would be beneficial to deliver lost circulation materials into wellbore 12.

Objects 68 can include lost circulation shapes that can be too large to pass through mud pumps. In addition, passing objects 68 through a mud pump would damage the shape of the lost circulation shape, destroying the loss curing properties of the lost circulation shape. Instead of passing objects 68 through mud pumps, objects 68 can be loaded into volume transfer container 58 for delivery into wellbore 12 to plug and pressure seal the formation at the point where losses are occurring.

With fluid and objects 68, such as lost circulation shapes, loaded within volume transfer container 58, inlet valve 66 or outlet valve 74, or both inlet valve 66 and outlet valve 74 as applicable, can be manipulated to provide a fluid flow path from volume transfer container 58 to drilling assembly 36. When traveling from volume transfer container 58 to drilling assembly 36 and into wellbore 12, objects 68 do not pass through a pump.

When a sufficient volume of fluids and objects 68 have been delivered into wellbore 12 to address the lost circulation, inlet valve 66 or outlet valve 74, or both inlet valve 66 and outlet valve 74 as applicable, can be manipulated so that drilling fluids once again circulate into wellbore 12 without mixing with the contents of volume transfer container 58. Volume transfer container 58 can be refilled with fluid and objects and the process can be repeated as needed to address lost circulation concerns as drilling operations continue.

Embodiments of this disclosure provide systems and methods for downhole drill string deployment of large lost circulation or other large object, such as an object larger than 10 mm in diameter, that cannot pass through a standard charge pump or mud circulation pump. Such pumps can be, for example, centrifugal or positive displacement pumps. The systems and methods of this disclosure may also be used where objects can pass through the pumping system, but may become damaged by the associated pumping or valve mechanisms.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A system for delivering objects formed of a solid material into a circulation fluid of a subterranean well, the system including:

a drilling assembly having a drill string that extends into the subterranean well, the drill string having a central bore defining an interior portion of a fluid flow path for the circulation fluid;

an annulus located between an outer diameter surface of the drill string and an inner diameter surface of the subterranean well, the annulus defining an annular portion of the fluid flow path for the circulation fluid;

a mud tank in fluid communication with the annuls by way of a mud return line, the mud tank having a storage space for the circulation fluid;

a pump assembly in fluid communication with the mud tank by way of a suction line, the pump assembly operable to draw fluids from the mud tank through the suction line;

a main line extending from the pump assembly to the drilling assembly, the main line having a first junction and a second junction that is downstream of the first junction;

a volume transfer container comprising a first port and a second port, the volume transfer container selectively containing the objects formed of a solid material;

a first bypass line extending between the first port and the first junction;

a first valve in the main line at the first junction, the first valve selectively in an inline configuration providing fluid communication between upstream and downstream sides of the first valve, and changeable to a bypass configuration providing fluid communication between the first bypass line and the downstream side of the first valve;

a second bypass line extending between the second port and the second junction; and a second valve in the main line at the second junction, the second valve selectively in an inline configuration providing fluid communication between upstream and downstream sides of the second valve, and changeable to a bypass configuration providing fluid communication between the second bypass line and the upstream side of the second valve.

2. The system of claim 1, further comprising an intermediate pump disposed in the second bypass line.

3. The system of claim 2, where the intermediate pump urges the objects formed of a solid material in the volume transfer container into a portion of the main line between the first and second valves and when the first and second valves are in the bypass configuration.

4. The system of claim 3, where changing the first and second valves from the bypass configuration to the inline configuration causes the objects formed of a solid material to flow in the main line downstream of the second valve.

5. The system of claim 3, where the pump output is a low pressure pump output of a low pressure pump.

6. The system of claim 1, where a portion of the main line adjacent the pump assembly comprises a discharge line and a portion of the main line adjacent the drilling assembly comprises a transfer line.

7. The system of claim 1, where the objects formed of a solid material comprise a lost circulation material.

8. The system of claim 1, where the volume transfer container comprises a container selected from the list consisting of a tank containing a baffle labyrinth located between the inlet port and the outlet port, a tank containing an internal piston assembly with a piston head operable to move in a direction from the inlet port towards the outlet port, and a pipe assembly containing one or more tubular members secured in line with both the discharge line and the transfer line.

9. A method for delivering objects formed of a solid material into a circulation fluid of a subterranean well, the method including:

extending a drill string of a drilling assembly into the subterranean well, the drill string having a central bore defining an interior portion of a fluid flow path for the circulation fluid, and defining an annulus located between an outer diameter surface of the drill string and an inner diameter surface of the subterranean well, the annulus defining an annular portion of the fluid flow path for the circulation fluid;

circulating the circulation fluid into the subterranean well with a circulation system, the circulation system including:

a mud tank in fluid communication with the annulus by way of a mud return line, the mud tank having a storage space for the circulation fluid;

a pump assembly in fluid communication with the mud tank by way of a suction line, the pump assembly drawing fluids from the mud tank through the suction line;

a main line extending from a discharge of the pump assembly to the drilling assembly, and that comprises a first junction and a second junction that is downstream of the first junction, a volume transfer container that comprises first and second ports, a first bypass line that connects the first junction to the first port, a second bypass line that connects the second junction to the second port, urging objects formed of a solid material from inside the volume transfer container into a portion of the main line between first and second valves by configuring the first valve to provide communication between a downstream port of the first valve and the first bypass line and configuring the second valve to provide communication between an upstream port of the second valve and the second bypass line; and urging the objects formed of a solid material from the portion of the main line between the first and second valves and to the drilling assembly by configuring the first valve so that upstream and downstream ports of the first valve are in communication and configuring the second valve so that upstream and downstream ports of the second valve are in communication.

10. The method of claim 9, wherein an intermediate pump is provided in the second bypass line, the method further including activating the pump when both the second valve is configured so that the upstream port of the second valve is in communication with the second bypass line.

11. The method of claim 10, where the intermediate pump output is a low pressure pump output of a low pressure pump.

12. The method of claim 9, wherein the objects formed of a solid material comprise lost circulation material.

13. The method of claim 9, where the volume transfer container is a tank containing a baffle labyrinth located between the inlet port and the outlet port, and where the method further includes sweeping the circulation fluid through the baffle labyrinth and out of the outlet port.

14. The method of claim 9, where the volume transfer container is a tank containing an internal piston assembly with a piston head, and where the method further includes sweeping the circulation fluid out of the outlet port by moving the piston head in a direction towards the outlet port.

15. The method of claim 9, where the volume transfer container is a pipe assembly containing one or more tubular members secured in line with both the discharge line and the transfer line, and where the method further includes sweeping the circulation fluid out of the outlet port of the pipe assembly.

* * * * *